US012791017B2

(12) United States Patent
Sakai et al.

(10) Patent No.: US 12,791,017 B2
(45) Date of Patent: Nov. 10, 2026

(54) THERMAL MANAGEMENT SYSTEM

(71) Applicant: DENSO CORPORATION, Kariya-city (JP)

(72) Inventors: Koji Sakai, Kariya-city (JP); Toshitada Sanzen, Kariya-city (JP)

(73) Assignee: DENSO CORPORATION, Kariya-city (JP)

( * ) Notice: Subject to any disclaimer, the term of this patent is extended or adjusted under 35 U.S.C. 154(b) by 103 days.

(21) Appl. No.: 19/032,362

(22) Filed: Jan. 20, 2025

(65) Prior Publication Data

US 2025/0188918 A1 Jun. 12, 2025

Related U.S. Application Data

(63) Continuation of application No. PCT/JP2023/024623, filed on Jul. 3, 2023.

(30) Foreign Application Priority Data

Jul. 28, 2022 (JP) ..... 2022-120624

(51) Int. Cl.
*F04B 39/06* (2006.01)
*F25B 31/00* (2006.01)
*F25B 41/31* (2021.01)

(52) U.S. Cl.
CPC ..... *F04B 39/06* (2013.01); *F25B 31/006* (2013.01); *F25B 41/31* (2021.01)

(58) Field of Classification Search
CPC ..... F04B 29/06; F25B 41/31; F25B 31/006; F25B 31/008; F25B 25/005; F25B 49/025
See application file for complete search history.

(56) References Cited

U.S. PATENT DOCUMENTS

2003/0200761 A1 10/2003 Funahashi et al.
2005/0223727 A1 10/2005 Funahashi et al.
2006/0064998 A1 3/2006 Funahashi et al.
(Continued)

FOREIGN PATENT DOCUMENTS

JP 2003322082 A 11/2003
JP 2007064173 A 3/2007
(Continued)

*Primary Examiner* — Cassey D Bauer
(74) *Attorney, Agent, or Firm* — Harness, Dickey & Pierce, P.L.C.

(57) ABSTRACT

An electric compressor of a refrigeration cycle apparatus in a thermal management system includes a housing, an electric motor, a refrigerant compression unit, an electric control device, a refrigerant flow passage and a coolant flow passage. The electric control device includes an electronic component which is configured to generate heat in response to energization thereof. The electric control device controls energization of windings of the electric motor. The refrigerant flow passage, which is formed at an inside of the housing, enables exchange of heat between: a refrigerant, which flows in the refrigerant flow passage before being suctioned into the refrigerant compression unit; and the windings and the electronic component. A coolant flow passage, which is formed at the inside of the housing, enables exchange of heat between: a coolant, which flows in the coolant flow passage; and the windings and the electronic component.

4 Claims, 7 Drawing Sheets

(56) References Cited

U.S. PATENT DOCUMENTS

| | | | | |
|---|---|---|---|---|
| 2015/0338134 | A1 | 11/2015 | Taniguchi et al. | |
| 2017/0370626 | A1 | 12/2017 | Ohyama et al. | |
| 2019/0345956 | A1 | 11/2019 | Iizuka et al. | |
| 2021/0180805 | A1* | 6/2021 | Jang ..... | F24F 5/001 |

FOREIGN PATENT DOCUMENTS

| | | | |
|---|---|---|---|
| JP | 2014028606 | A | 2/2014 |
| JP | 2016142418 | A | 8/2016 |
| WO | WO-2018139497 | A1 | 8/2018 |

* cited by examiner

THERMAL MANAGEMENT SYSTEM

CROSS REFERENCE TO RELATED APPLICATION

This application is a continuation application of International Patent Application No. PCT/JP2023/024623 filed on Jul. 3, 2023, which designated the U.S. and claims the benefit of priority from Japanese Patent Application No. 2022-120624 filed on Jul. 28, 2022. The entire disclosures of all of the above applications are incorporated herein by reference.

TECHNICAL FIELD

The present disclosure relates to an electric compressor for a refrigeration cycle apparatus and a thermal management system including the refrigeration cycle apparatus and a coolant circuit.

BACKGROUND ART

Previously, there has been proposed an electric compressor for a refrigeration cycle apparatus.

The previously proposed electric compressor includes: an electric motor and a refrigerant compression unit placed at an inside of a housing; and an electric control device which is placed at an outside of the housing and controls the electric motor. This electric compressor is configured to cool windings of the electric motor using a refrigerant which has a low temperature and a low pressure and flows in the inside of the housing. The electric compressor is also configured to cool switching devices of an inverter circuit of the electric control device using this refrigerant through the housing.

SUMMARY

This section provides a general summary of the disclosure, and is not a comprehensive disclosure of its full scope or all of its features.

According to one aspect of the present disclosure, there is provided an electric compressor for a refrigeration cycle apparatus. The electric compressor includes a housing, an electric motor, a refrigerant compression unit, an electric control device, a refrigerant flow passage and a coolant flow passage. The housing forms an outer shell of the electric compressor. The electric motor is installed at an inside of the housing and is configured to be rotated in response to energization of a plurality of windings of the electric motor. The refrigerant compression unit is configured to be driven by the electric motor so as to suction a refrigerant and discharge the refrigerant after compressing the refrigerant. The electric control device includes an electronic component which is configured to generate heat in response to energization of the electronic component. The electric control device is configured to control the energization of the plurality of windings of the electric motor. The refrigerant flow passage is formed at the inside of the housing. The refrigerant flow passage is configured to enable exchange of heat between: the refrigerant, which flows in the refrigerant flow passage before being suctioned into the refrigerant compression unit and has a low temperature and a low pressure; and the plurality of windings and the electronic component. The coolant flow passage is formed at the inside of the housing. The coolant flow passage is configured to enable exchange of heat between: a coolant, which flows in the coolant flow passage; and the plurality of windings and the electronic component.

According to another aspect of the present disclosure, there is provided a thermal management system including a refrigeration cycle apparatus and a coolant circuit. The refrigeration cycle apparatus is configured to circulate the refrigerant among: the electric compressor of the one aspect described above; a high-temperature side refrigerant-coolant heat exchanger, which is configured to exchange heat between the refrigerant discharged from the refrigerant compression unit of the electric compressor and the coolant; an expansion valve, which is configured to decompress and expand the refrigerant outputted from the high-temperature side refrigerant-coolant heat exchanger; and a low-temperature side refrigerant-heat medium heat exchanger, which is configured to exchange heat between the refrigerant outputted from the expansion valve and a heat medium. The electric compressor, the high-temperature side refrigerant-coolant heat exchanger, the expansion valve and the low-temperature side refrigerant-heat medium heat exchanger are connected through a refrigerant pipeline to circulate the refrigerant in the refrigerant cycle apparatus. The coolant circuit is configured to circulate the coolant among: a high-temperature side coolant-air heat exchanger, which is configured to exchange heat between air and the coolant; the high-temperature side refrigerant-coolant heat exchanger; and a coolant pump. The high-temperature side coolant-air heat exchanger, the high-temperature side refrigerant-coolant heat exchanger and the coolant pump are connected through a coolant pipeline to circulate the coolant in the coolant circuit. The coolant flow passage of the electric compressor is a flow passage that is configured to conduct the coolant from the high-temperature side coolant-air heat exchanger to the high-temperature side refrigerant-coolant heat exchanger.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
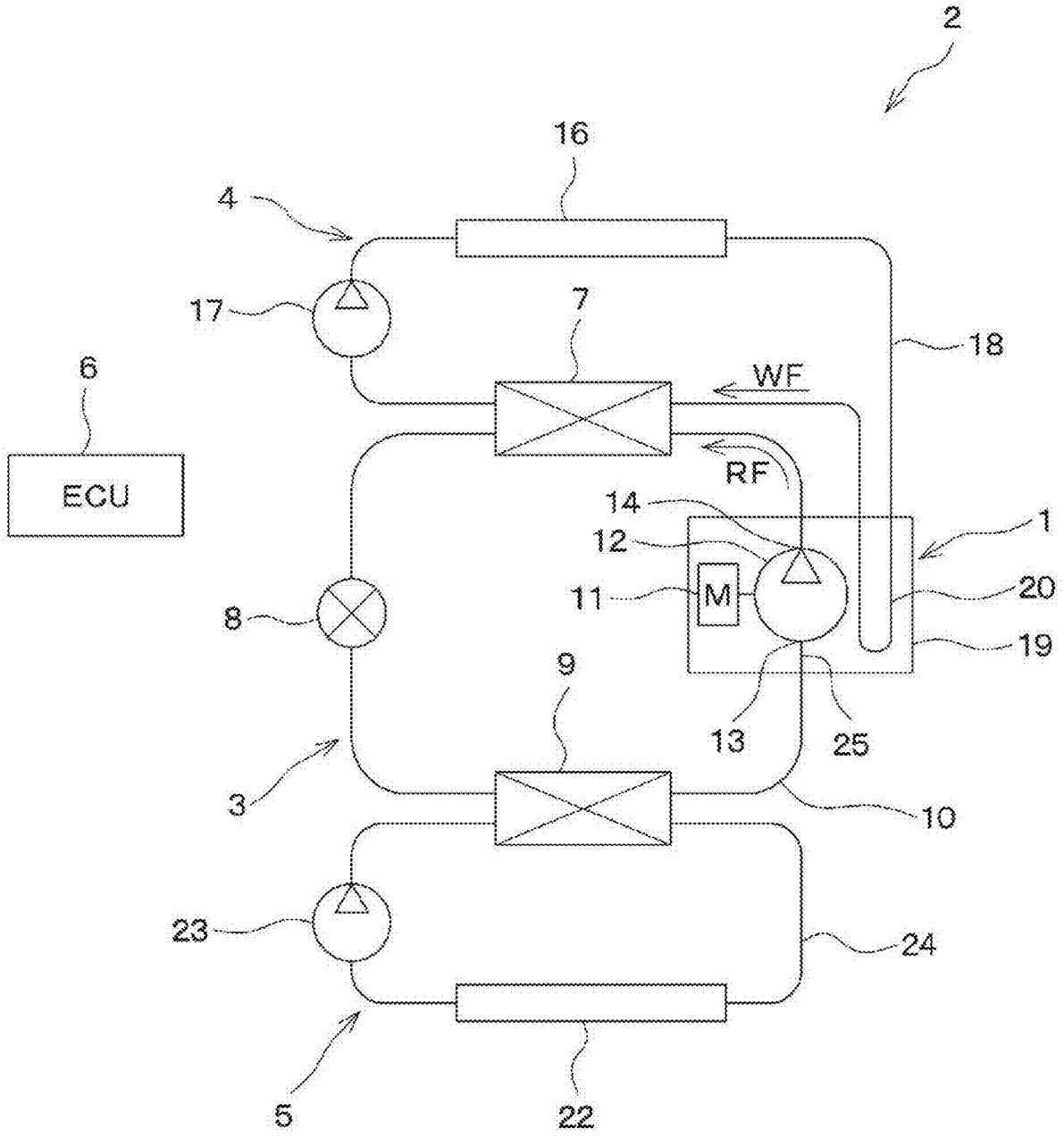
FIG. 1 is a diagram showing a schematic structure of a thermal management system including an electric compressor according to a first embodiment.

Previously, there has been proposed an electric compressor for a refrigeration cycle apparatus.

The previously proposed electric compressor includes: an electric motor and a refrigerant compression unit placed at an inside of a housing; and an electric control device which is placed at an outside of the housing and controls the electric motor. This electric compressor is configured to cool windings of the electric motor using a refrigerant which has a low temperature and a low pressure and flows in the inside of the housing. The electric compressor is also configured to cool switching devices of an inverter circuit of the electric control device using this refrigerant through the housing.

However, the structure, such as that of the previously proposed electric compressor, which is configured to cool the electric motor and the electric control device using only the refrigerant, has the following issues.

First, in a case where, for example, space heating or the like is performed using the heat of the refrigerant flowing in a condenser of the refrigeration cycle apparatus during an extremely low outside air temperature of an outdoor environment (hereinafter simply referred to as an extremely low outside air temperature), the temperature of the refrigerant needs to be reduced below the outside air temperature to enable absorption of the heat from the outside air to the refrigerant at the evaporator. Therefore, when the temperature of the refrigerant, which is suctioned into the electric compressor from the evaporator, falls below the guaranteed lower temperature limit (for example, −40 degrees Celsius) of an electronic component of the electric control device, there is a risk of failure of the electronic component. Additionally, there is a concern that the use of the refrigeration cycle for the space heating or the like may be hindered in order to protect the electronic component.

Furthermore, with respect to the operating condition of the refrigeration cycle apparatus, when the electric compressor is operated at the low rotational speed, a flow rate of the refrigerant decreases, and thereby a cooling capacity of the refrigerant for cooling the windings of the electric motor is reduced. At that time, under an operating condition where the electric motor requires the output torque at the high load, the increase in the electric current may possibly cause the temperature of the windings to rise, potentially exceeding the protection temperature of the windings. Therefore, there is required the control that changes the operating point of the electric compressor or temporarily stops the electric compressor to limit the temperature of the windings from rising above the protection temperature of the windings, resulting in a concern about limiting the operating range of the electric compressor.

Furthermore, generally, the refrigerant used in the refrigeration cycle has a large temperature difference between the time of low temperature and the time of high temperature. Therefore, there is a concern that when the temperature change in the electronic component, which exchanges the heat with this refrigerant, becomes large, a lifespan of the electronic component is shortened.

According to one aspect of the present disclosure, there is provided an electric compressor for a refrigeration cycle apparatus. The electric compressor includes a housing, an electric motor, a refrigerant compression unit, an electric control device, a refrigerant flow passage and a coolant flow passage. The housing forms an outer shell of the electric compressor. The electric motor is installed at an inside of the housing and is configured to be rotated in response to energization of a plurality of windings of the electric motor. The refrigerant compression unit is configured to be driven by the electric motor so as to suction a refrigerant and discharge the refrigerant after compressing the refrigerant. The electric control device includes an electronic component which is configured to generate heat in response to energization of the electronic component. The electric control device is configured to control the energization of the plurality of windings of the electric motor. The refrigerant flow passage is formed at the inside of the housing. The refrigerant flow passage is configured to enable exchange of heat between: the refrigerant, which flows in the refrigerant flow passage before being suctioned into the refrigerant compression unit and has a low temperature and a low pressure; and the plurality of windings and the electronic component. The coolant flow passage is formed at the inside of the housing. The coolant flow passage is configured to enable exchange of heat between: a coolant, which flows in the coolant flow passage; and the plurality of windings and the electronic component.

Accordingly, the plurality of windings and the electronic component can exchange the heat with the refrigerant flowing in the refrigerant flow passage and with the coolant flowing in the coolant flow passage. Therefore, when using the refrigeration cycle apparatus for the space heating or the like during the extremely low outside air temperature, even in the case where the temperature of the refrigerant in the refrigerant flow passage drops below the guaranteed lower temperature limit of the electronic component, the heat exchange between the coolant and the electronic component can limit the temperature of the electronic component from falling below the guaranteed lower temperature limit.

Additionally, with respect to the operating condition of the refrigeration cycle apparatus, at the time of operating the electric compressor at the low rotational speed and the high load, even when the flow rate of the refrigerant is decreased and thereby the cooling capacity of the refrigerant for cooling the windings is reduced, it is possible to limit the temperature of the windings from rising above the protection temperature of the windings through heat exchange between the coolant and the windings. Therefore, it is possible to suppress the need for the control that limits the rising of the temperature of the windings above the protection temperature of the windings by changing the operating point of the electric compressor or temporarily stopping or intermittently operating the electric compressor. Thus, the occurrence of limiting the operating range of the electric compressor can be suppressed.

Furthermore, in general, a temperature difference between the temperature of the coolant flowing in the coolant flow passage at the low temperature time and the temperature of the coolant flowing in the coolant flow passage at the high temperature time is smaller than a temperature difference between the temperature of the refrigerant flowing in the refrigerant flow passage at the low temperature time and the temperature of the refrigerant flowing in the refrigerant flow passage at the high temperature time. Therefore, by configuring the structure such that the coolant flowing in the coolant flow passage and the electronic component exchange the heat, it is possible to limit the temperature change of the electronic component. Therefore, it is possible to extend the lifespan of the electronic component.

In the present disclosure, the electric compressor is not limited to the electric compressor including the electric motor and the refrigerant compression unit described above but may be an electric compressor including various components (e.g., a liquid reservoir and/or an oil separator) of the refrigeration cycle apparatus integrated with the constituent components described above.

Furthermore, according to another aspect of the present disclosure, there is provided a thermal management system including a refrigeration cycle apparatus and a coolant circuit. The refrigeration cycle apparatus is configured to circulate the refrigerant among: the electric compressor of the one aspect described above; a high-temperature side refrigerant-coolant heat exchanger, which is configured to exchange heat between the refrigerant discharged from the refrigerant compression unit of the electric compressor and the coolant; an expansion valve, which is configured to decompress and expand the refrigerant outputted from the high-temperature side refrigerant-coolant heat exchanger; and a low-temperature side refrigerant-heat medium heat exchanger, which is configured to exchange heat between the refrigerant outputted from the expansion valve and a heat medium. The electric compressor, the high-temperature side refrigerant-coolant heat exchanger, the expansion valve and the low-temperature side refrigerant-heat medium heat exchanger are connected through a refrigerant pipeline to circulate the refrigerant in the refrigerant cycle apparatus. The coolant circuit is configured to circulate the coolant among: a high-temperature side coolant-air heat exchanger, which is configured to exchange heat between air and the coolant; the high-temperature side refrigerant-coolant heat exchanger; and a coolant pump. The high-temperature side coolant-air heat exchanger, the high-temperature side refrigerant-coolant heat exchanger and the coolant pump are connected through a coolant pipeline to circulate the coolant in the coolant circuit. The coolant flow passage of the electric compressor is a flow passage that is configured to conduct the coolant from the high-temperature side coolant-air heat exchanger to the high-temperature side refrigerant-coolant heat exchanger.

Accordingly, the coolant flowing from the high-temperature side coolant-air heat exchanger to the high-temperature side refrigerant-coolant heat exchanger is the coolant that has released the heat to the air at the high-temperature side coolant-air heat exchanger and absorbs the heat from the refrigerant at the high-temperature side refrigerant-coolant heat exchanger. Therefore, by using the coolant on the upstream side of the high-temperature side refrigerant-coolant heat exchanger, compared to using the coolant on the downstream side of the high-temperature side refrigerant-coolant heat exchanger, it is possible to enhance the cooling efficiency of the windings by the coolant and increase the amount of heat absorption from the windings by the coolant. Thus, in addition to the cooling of the windings, it is possible to enhance the efficiency of the thermal management system by increasing the temperature of the coolant circulating in the coolant circuit.

Furthermore, the thermal management system may include an electronic controller device that is configured to control an operation of the coolant pump and an operation of the electric compressor. The electronic controller device is configured to activate the coolant pump at a time that is in advance of activation of the electric compressor by a predetermined time period. The electronic controller device is configured to deactivate the coolant pump at a time that is after elapse of a predetermined time period from a time of deactivation of the electric compressor.

The electronic controller device (or referred to as a controller) may include a processor and a memory that stores instructions configured to, when executed by the processor, cause the processor to: activate the coolant pump at a time that is in advance of activation of the electric compressor by a predetermined time period; and deactivate the coolant pump at a time that is after elapse of a predetermined time period from a time of deactivation of the electric compressor.

Hereinafter, embodiments of the present disclosure will be described with reference to the drawings. In each of the following embodiments, portions, which are the same or equivalent to each other, will be indicated by the same reference signs, and the description thereof will be omitted.

First Embodiment

The first embodiment will be described with reference to the drawings. As shown in FIG. 1, an electric compressor 1 according to the first embodiment is used in a thermal management system 2 installed in a vehicle.

<Structure of Thermal Management System 2>

First, a structure of the thermal management system 2 will be described. As shown in FIG. 1, the thermal management system 2 includes a refrigeration cycle apparatus 3, a first coolant circuit 4, a second coolant circuit 5 and an electronic controller device (also referred to as a controller) 6. The electronic controller device 6 will be hereinafter referred to as an ECU 6. Here, ECU stands for Electronic Control Unit. The first coolant circuit 4 is an example of a coolant circuit.

The refrigeration cycle apparatus 3 is a vapor compression refrigeration cycle in which the electric compressor 1, a high-temperature side refrigerant-coolant heat exchanger 7, an expansion valve 8 and a low-temperature side refrigerant-coolant heat exchanger 9 are connected through a refrigerant pipeline 10 to circulate a refrigerant therethrough. The low-temperature side refrigerant-coolant heat exchanger 9 is an example of a low-temperature side refrigerant-heat medium heat exchanger. As the refrigerant circulated in the refrigeration cycle apparatus 3. for example, an HFC refrigerant (e.g., R134a) or HFO refrigerant (e.g., R1234yf) is used. In addition, a natural refrigerant (e.g., carbon dioxide) may be used as the refrigerant. An arrow RF shown in FIG. 1 indicates a direction in which the refrigerant flows through the refrigerant pipeline 10.

The electric compressor 1 includes an electric motor 11 and a refrigerant compression unit 12. The electric motor 11 is rotated in response to energization thereof. The refrigerant compression unit 12 is driven by the electric motor 11 so as to suction the refrigerant from a refrigerant suction inlet 13 and discharge the refrigerant through a refrigerant discharge outlet 14 after compressing the refrigerant. As the refrigerant compression unit 12, a fixed displacement type refrigerant compression unit or a variable displacement type refrigerant compression unit may be used. A specific structure of the electric compressor 1 will be described later.

The refrigerant, which is discharged from the electric compressor 1 and has a high temperature and a high pressure, flows into the high-temperature side refrigerant-coolant heat exchanger 7. The high-temperature side refrigerant-coolant heat exchanger 7 is a heat exchanger that exchanges heat between the refrigerant and a coolant (a water-based coolant) circulated through the first coolant circuit 4. The high-temperature side refrigerant-coolant heat exchanger 7 is also referred to as a water-cooled condenser. The refrigerant, which flows through the high-temperature side refrigerant-coolant heat exchanger 7, is cooled by releasing heat to the coolant.

The refrigerant, which flows out from the high-temperature side refrigerant-coolant heat exchanger 7, is decompressed and expanded at the time of passing through the expansion valve 8 and flows into the low-temperature side refrigerant-coolant heat exchanger 9 in a two-phase gas-liquid state. As the expansion valve 8, a variable restrictor such as a thermostatic expansion valve or an electronic expansion valve, or a fixed restrictor may be used.

The low-temperature side refrigerant-coolant heat exchanger 9 is a heat exchanger that exchanges heat between the refrigerant and the coolant circulated through the second coolant circuit 5. The coolant flowing through the low-temperature side refrigerant-coolant heat exchanger 9 (i.e., the coolant circulating in the second coolant circuit 5) is an example of a heat medium. The low-temperature side refrigerant-coolant heat exchanger 9 is also referred to as a chiller. The refrigerant flowing through the low-temperature side refrigerant-coolant heat exchanger 9 evaporates by absorbing heat from the coolant. The refrigerant, which flows out from the low-temperature side refrigerant-coolant heat exchanger 9, is suctioned into the refrigerant suction inlet 13 of the electric compressor 1.

The first coolant circuit 4 circulates the coolant among the high-temperature side refrigerant-coolant heat exchanger 7, a first coolant pump 17 and a high-temperature side coolant-air heat exchanger 16 which are connected through a coolant pipeline 18 to circulate the coolant. The first coolant pump 17 is an example of a coolant pump. An antifreeze liquid (i.e. LLC) is used as the coolant that is circulated through the first coolant circuit 4. Here, LLC stands for Long Life Coolant. An arrow WF shown in FIG. 1 indicates a direction in which the coolant flows through the coolant pipeline 18.

The high-temperature side refrigerant-coolant heat exchanger 7 is the same as that described with reference to the refrigeration cycle apparatus 3. The coolant, which flows through the high-temperature side refrigerant-coolant heat exchanger 7, is heated by absorbing heat from the refrigerant.

The high-temperature side coolant-air heat exchanger 16 is a heat exchanger that exchanges heat between the coolant and the air. The air, which is heated by the high-temperature side coolant-air heat exchanger 16, is used for the air conditioning of a vehicle cabin of the vehicle (specifically, space heating or the like of the vehicle cabin). This high-temperature side coolant-air heat exchanger 16 is also called a heater core. The coolant, which flows through the high-temperature side coolant-air heat exchanger 16, is cooled by releasing the heat to the air. The coolant, which flows out of the high-temperature side coolant-air heat exchanger 16, flows in a coolant flow passage 20 formed at an inside of the housing 19 of the electric compressor 1 and then flows into the high-temperature side refrigerant-coolant heat exchanger 7. The structure as well as effects and advantages of the coolant flow passage 20 will be discussed later.

The first coolant pump 17 is an electric water pump. The coolant is circulated through the first coolant circuit 4 by driving the first coolant pump 17.

The second coolant circuit 5 circulates the coolant among the low-temperature side refrigerant-coolant heat exchanger 9, a low-temperature side coolant and air heat exchanger 22 and a second coolant pump 23 which are connected through a coolant pipeline 24 to circulate the coolant therethrough. The antifreeze liquid (i.e. LLC) is used as the coolant that is circulated through the second coolant circuit 5.

The low-temperature side refrigerant-coolant heat exchanger 9 is the same as that described with reference to the refrigeration cycle apparatus 3. The coolant, which flows through the low-temperature side refrigerant-coolant heat exchanger 9, is cooled by releasing heat to the refrigerant.

The low-temperature side coolant and air heat exchanger 22 is a heat exchanger that exchanges heat between the coolant and the air. The air, which is cooled by the low-temperature side coolant and air heat exchanger 22, is used for the air conditioning of the vehicle cabin (specifically, cooling or the like of the vehicle cabin).

The second coolant pump 23 is an electric water pump. The coolant is circulated through the second coolant circuit 5 by driving the second coolant pump 23.

The ECU 6 includes: a microcomputer, which has a processor that performs controls and arithmetic operations; a memory that stores programs and data; and peripheral circuits around the microcomputer. The processor includes, for example, a CPU and an MPU. The memory includes various non-transitory tangible storage media such as ROM, a RAM, and a non-volatile rewritable memory. The ECU 6 controls the operations of the electric compressor 1, the first coolant pump 17, the second coolant pump 23, and others by executing the programs stored in the memory with its processor. The control processes executed by the ECU 6 will be described later.

Although not illustrated in the drawings, in addition to the first coolant circuit 4 and the second coolant circuit 5, the thermal management system 2 may include another coolant circuit(s) and/or another heat medium circuit(s). Also, the cooling or heating of the vehicle's battery, a drive engine and/or a drive motor for driving the vehicle, etc., may be performed by these coolant circuit(s) and/or the heat medium circuit(s).

<Structure of Electric Compressor 1>

Figure 2:
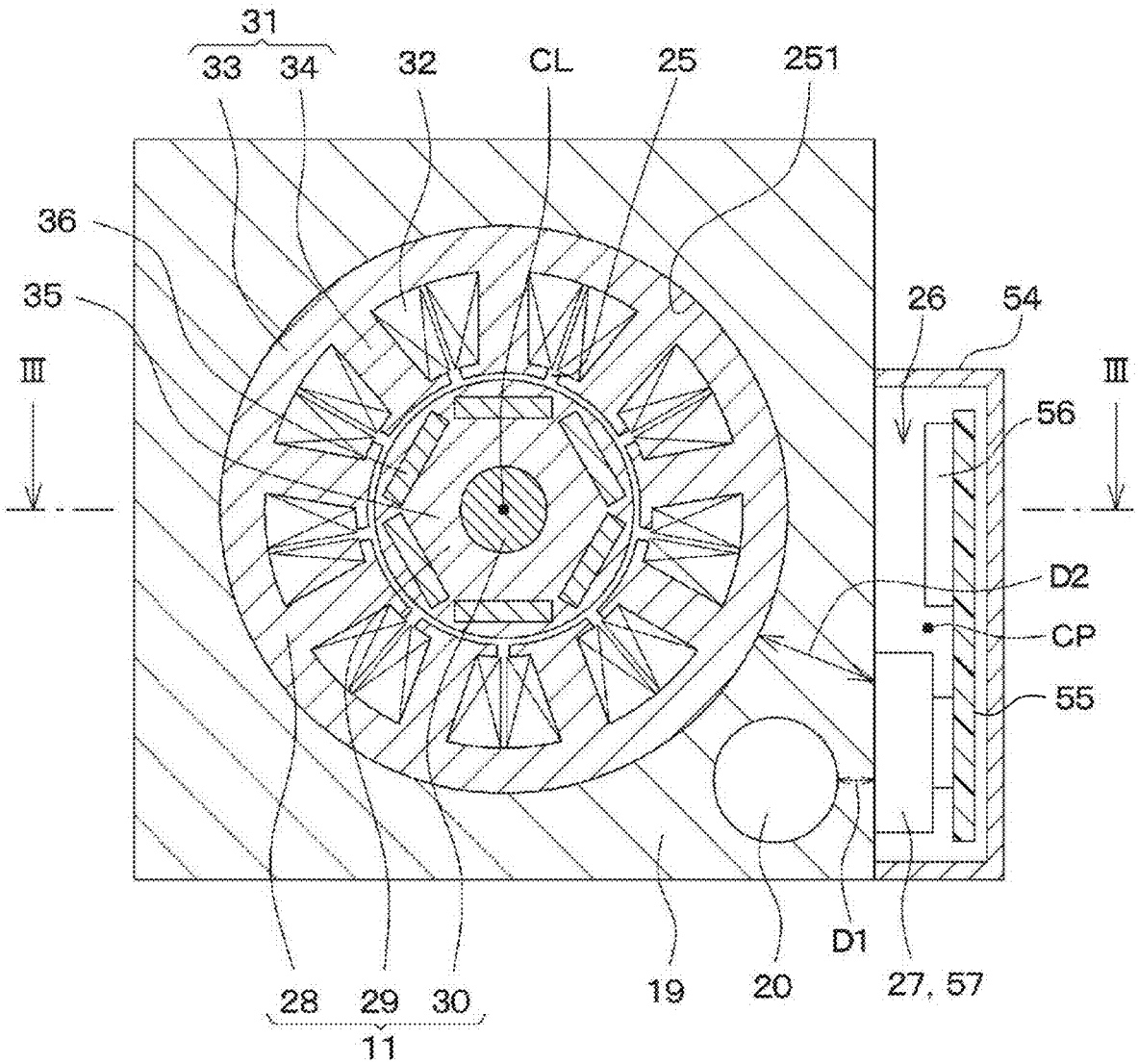
FIG. 2 is a cross-sectional view showing a schematic structure of the electric compressor.
Figure 3:
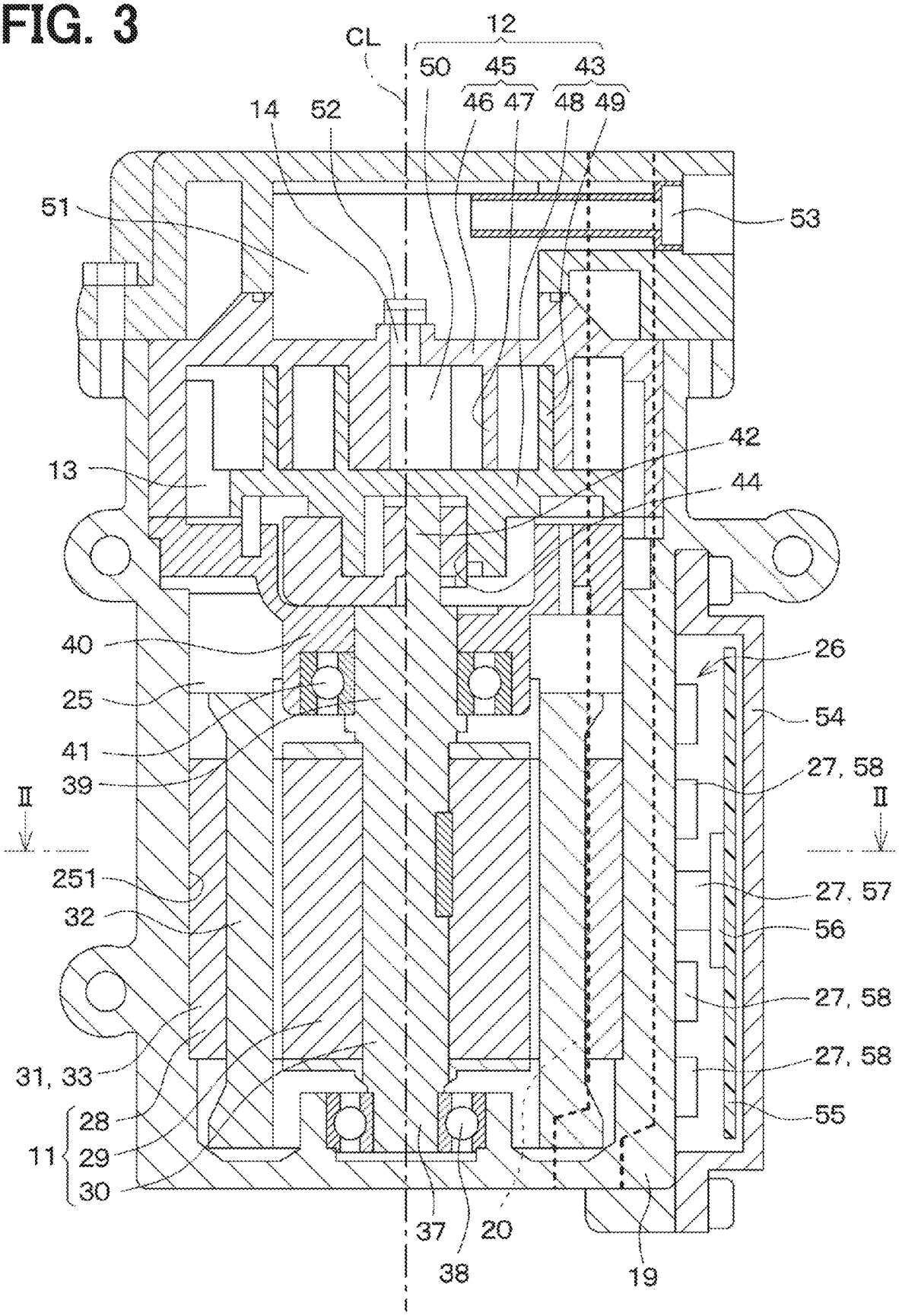
FIG. 3 is a cross-sectional view taken along line III-III in FIG. 2.

Next, a specific structure of the electric compressor 1 will be described. As shown in FIGS. 2 and 3, the electric compressor 1 includes a housing 19, a refrigerant flow passage 25, the coolant flow passage 20, the electric motor 11, the refrigerant compression unit 12 and an electric control device (also referred to as an electric control circuitry) 26.

The housing 19 is made of, for example, metal and forms an outer shell of the electric compressor 1. The housing 19 has a sealed container structure formed by joining a plurality of members. The refrigerant flow passage 25, the coolant flow passage 20, the electric motor 11 and the refrigerant compression unit 12 are received at an inside of the housing 19.

The refrigerant flow passage 25, as mentioned above, is the flow passage through which the gas phase refrigerant, which has a low temperature and a low pressure (compared to those after the refrigerant compression unit 12) and is outputted from the low-temperature side refrigerant-coolant heat exchanger 9 of the refrigeration cycle apparatus 3, flows before being suctioned into the refrigerant compression unit 12. The refrigerant flow passage 25 is formed as a space inside the housing 19 where the electric motor 11 is located. Therefore, the refrigerant, which flows in the refrigerant flow passage 25, flows through gaps between the components of the electric motor 11, and by directly exchanging heat with the components of the electric motor 11, it is possible to cool the electric motor 11. Additionally, the refrigerant, which flows in the refrigerant flow passage 25, can cool electronic components 27 of the electric control device 26 by exchanging heat with the electronic components 27 through the housing 19. The refrigerant flow passage 25 is configured such that the refrigerant, which flows in the refrigerant flow passage 25, is suctioned into the refrigerant compression unit 12.

As described above, the coolant flow passage 20 is a flow passage that conducts the coolant, which flows out from the high-temperature side coolant-air heat exchanger 16 of the first coolant circuit 4 and flows into the high-temperature side refrigerant-coolant heat exchanger 7. The coolant flow passage 20 is configured to conduct the coolant through a through-hole formed at the inside of the housing 19. The through-hole, which forms the coolant flow passage 20, is formed at a corresponding location of the housing 19 which is between the electric motor 11 and the electric control device 26. Therefore, the coolant, which flows in the coolant flow passage 20, can exchange the heat with the corresponding respective components of the electric motor 11 through the housing 19. Furthermore, the coolant, which flows in the coolant flow passage 20, can exchange heat with, for example, the electronic components 27 of the electric control device 26 through the housing 19.

The electric motor 11 is located at an inside of the refrigerant flow passage 25 formed at the inside of the housing 19. As the electric motor 11, various types of electric motors, such as a DC motor or an AC motor, can be used. In the present embodiment, for example, a brushless motor is used as the electric motor 11. The electric motor 11 includes a stator 28, a rotor 29 and a shaft 30.

The stator 28 includes a stator core 31 and a plurality of windings 32. The stator core 31 has: an outer peripheral portion 33, which is shaped in a tubular form; and a plurality of teeth 34, each of which radially inwardly extends from the outer peripheral portion 33. The stator core 31 is fixed to an inner wall 251 of the refrigerant flow passage 25. Each of the windings 32 is wound in a corresponding slot formed between corresponding adjacent two of the teeth 34. The windings 32 are, for example, three-phase windings with a connection such as a delta connection or a Y connection.

The rotor 29 includes a rotor core 35 and a plurality of magnets 36. The rotor 29 is positioned on the radially inner side of the stator 28 and is rotatable together with the shaft 30. The shaft 30 is positioned at the center of the rotor 29. An end portion 37 of the shaft 30, which extends from the rotor 29 to the side opposite to the refrigerant compression unit 12, is rotatably supported by a first bearing 38 installed at the housing 19. A portion 39 of the shaft 30, which extends from the rotor 29 to the side where the refrigerant compression unit 12 is located, is rotatably supported by a second bearing 41 installed at an intermediate support portion 40 fixed inside the housing 19.

The shaft 30 has an eccentric portion 42 formed at a location extending further toward the refrigerant compression unit 12 from the second bearing 41. The eccentric portion 42 is shaped in a solid cylindrical form and has its center offset from the central axis CL of the shaft 30. The eccentric portion 42 is slidably fitted into a bearing portion 44 of a movable scroll 43 in the refrigerant compression unit 12. Thus, the torque, which is outputted from the electric motor 11, is transmitted from the shaft 30 to the movable scroll 43, causing the movable scroll 43 to revolve around the central axis CL of the shaft 30.

As described above, the refrigerant flowing in the refrigerant flow passage 25 flows through gaps each of which is formed between the corresponding components of the electric motor 11 (e.g., gaps between the stator 28 and the rotor 29). Additionally, although not illustrated in the drawings, the refrigerant flow passage 25 may be formed as a passage through which the refrigerant flows around the outer periphery of the stator 28, or as a passage through which the refrigerant flows in the rotor 29 or the shaft 30.

The refrigerant compression unit 12 is driven by the electric motor 11. The refrigerant compression unit 12 can adopt various types of mechanisms, such as rotary, reciprocating, and variable displacement types. In this embodiment, for example, a scroll-type compressor, which is a rotary type, is employed. Therefore, the refrigerant compression unit 12 includes a fixed scroll 45 and the movable scroll 43.

The fixed scroll 45 includes: a fixed plate 46; and a fixed wrap 47 which is joined to the fixed plate 46 and is shaped in a spiral form. The fixed plate 46 is fixed to the housing 19. The fixed wrap 47 protrudes from the fixed plate 46 toward the movable plate 48 of the movable scroll 43.

The movable scroll 43 includes: a movable plate 48 opposed to the fixed plate 46; and a movable wrap 49 which is joined to the movable plate 48 and is shaped in a spiral form. The movable wrap 49 protrudes from the movable plate 48 toward the fixed plate 46. The fixed wrap 47 and the movable wrap 49 are meshed with each other. The movable scroll 43 is equipped with a self-rotation limiting mechanism (not shown) which limits its self-rotation. Therefore, the movable scroll 43 revolves around the central axis CL of the shaft 30 as its center of revolution without rotating itself.

A working chamber 50 is formed between the fixed scroll 45 and the movable scroll 43. Additionally, the refrigerant suction inlet 13 is located on a radially inner side of an outer peripheral wall of the fixed scroll 45 and on a radially outer side of the movable scroll 43. The refrigerant suction inlet 13 is communicated with the refrigerant flow passage 25. When the movable scroll 43 is driven by the electric motor 11 and thereby revolves, the refrigerant is suctioned into the working chamber 50 from the refrigerant suction inlet 13, and the refrigerant is compressed in response to a reduction in the volume of the working chamber 50.

The refrigerant discharge outlet 14, through which the refrigerant compressed in the working chamber 50 is discharged, is formed at the fixed plate 46 of the fixed scroll 45. The refrigerant discharge outlet 14 is communicated with a discharge space 51. A discharge check valve 52 is installed between the refrigerant discharge outlet 14 and the discharge space 51. The refrigerant, which is discharged from the refrigerant discharge outlet 14 into the discharge space 51, is discharged from a discharge port 53 provided in the housing 19.

The electric control device 26 controls the energization of the windings 32 of the electric motor 11. The electric control device 26 includes a circuit board 55, an integrated circuit (IC) 56, a filter 57 and a plurality of switching devices 58 which are provided at an inside of a case 54. An electrical circuit, which includes the IC 56, is provided on the circuit board 55. The filter 57 has, for example, a smoothing capacitor, and limits fluctuations in a voltage supplied from a battery (not shown) of the vehicle. The switching devices 58 form, for example, an inverter circuit that generates three-phase alternating currents to be supplied to the windings 32 of the electric motor 11.

As shown in FIG. 2, the filter 57 and the switching devices 58, which serve as the electronic components 27 and generate the heat in response to energization thereof, are positioned closer to the coolant flow passage 20 than a center location CP of the electric control device 26. Furthermore, the electronic components 27 (i.e., the filter 57 and the switching devices 58), which generate the heat in response to the energization thereof, are either directly connected to the housing 19 or indirectly connected to the housing 19 through a heat-conducting member (not shown). Therefore, the electronic components 27, which generate the heat in response to the energization thereof, can exchange the heat with the refrigerant flowing in the refrigerant flow passage 25 and with the coolant flowing in the coolant flow passage 20.

Additionally, as shown in FIGS. 2 and 3, the electronic components 27, which generate the heat in response to the energization thereof, are arranged to oppose the coolant flow passage 20 formed at the inside of the housing 19. Furthermore, as shown in FIG. 2, a distance D1 between the electronic component 27, which generates the heat in response to the energization thereof, and the coolant flow passage 20 is shorter than a distance D2 between the electronic component 27, which generates the heat in response to the energization thereof, and the refrigerant flow passage 25. This makes it possible to enhance the heat exchange efficiency between the electronic components 27, which generate the heat in response to the energization thereof, and the coolant flowing in the coolant flow passage 20.

In the structure described above, when the windings 32 of the electric motor 11 are energized by the electric control device 26, a rotating magnetic field is generated at the stator 28, causing the rotor 29 and the shaft 30 to rotate. The rotational motion of the shaft 30 is transmitted to the movable scroll 43. In response to revolution of the movable scroll 43, the refrigerant, which is suctioned into the working chamber 50 of the refrigerant compression unit 12 from the refrigerant flow passage 25, is compressed due to the reduction in the volume of the working chamber 50 and is then discharged through the discharge port 53 after passing through the refrigerant discharge outlet 14 and the discharge space 51. The refrigeration cycle apparatus 3 is operated in the above-described manner.

<Effects and Advantages of Coolant Flow Passage 20>

Next, the effects and advantages, which are achieved by forming the coolant flow passage 20 at the inside of the housing 19 in the electric compressor 1 of the present embodiment, will be described in comparison with an electric compressor of a comparative example. The electric compressor of the comparative example has the same structure as the electric compressor 1 of the first embodiment, except that the electric compressor of the comparative example does not have the coolant flow passage 20.

<Regarding Temperature of Electronic Components 27>

Figure 4:
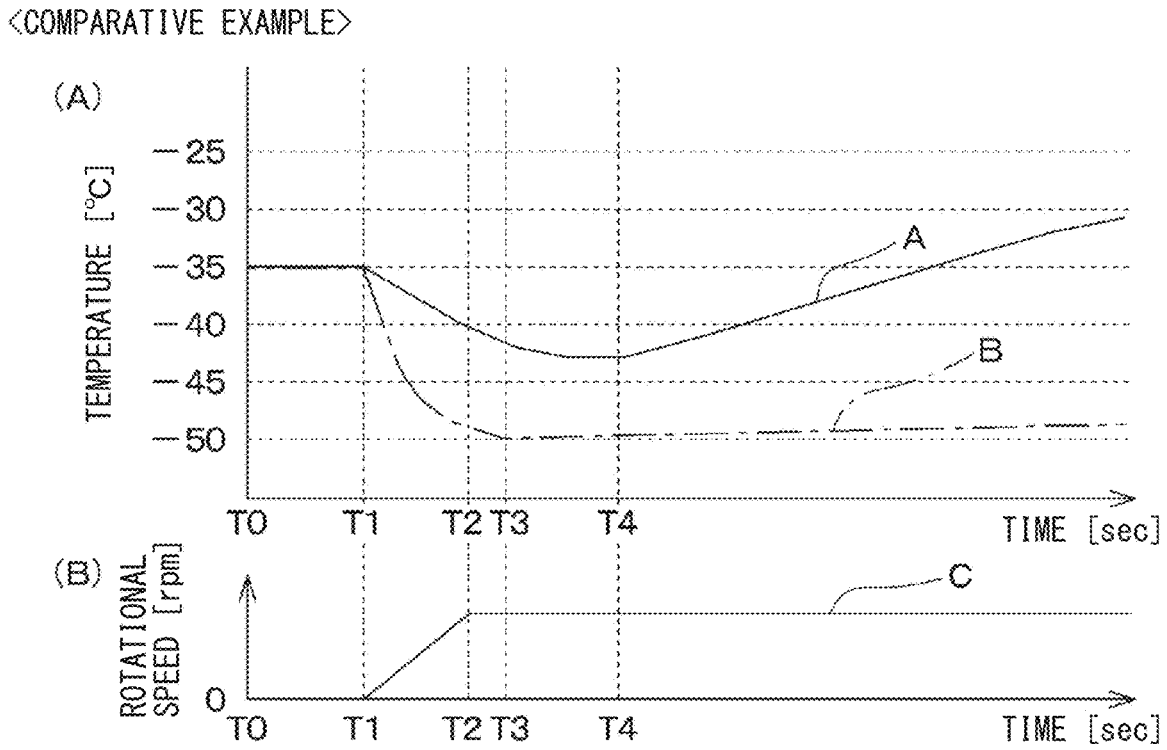
FIG. 4 is a graph showing a relationship between the temperature of a refrigerant and the temperature of an electronic component immediately after start-up of an electric compressor of a comparative example under an extremely low ambient temperature environment.
Figure 5:
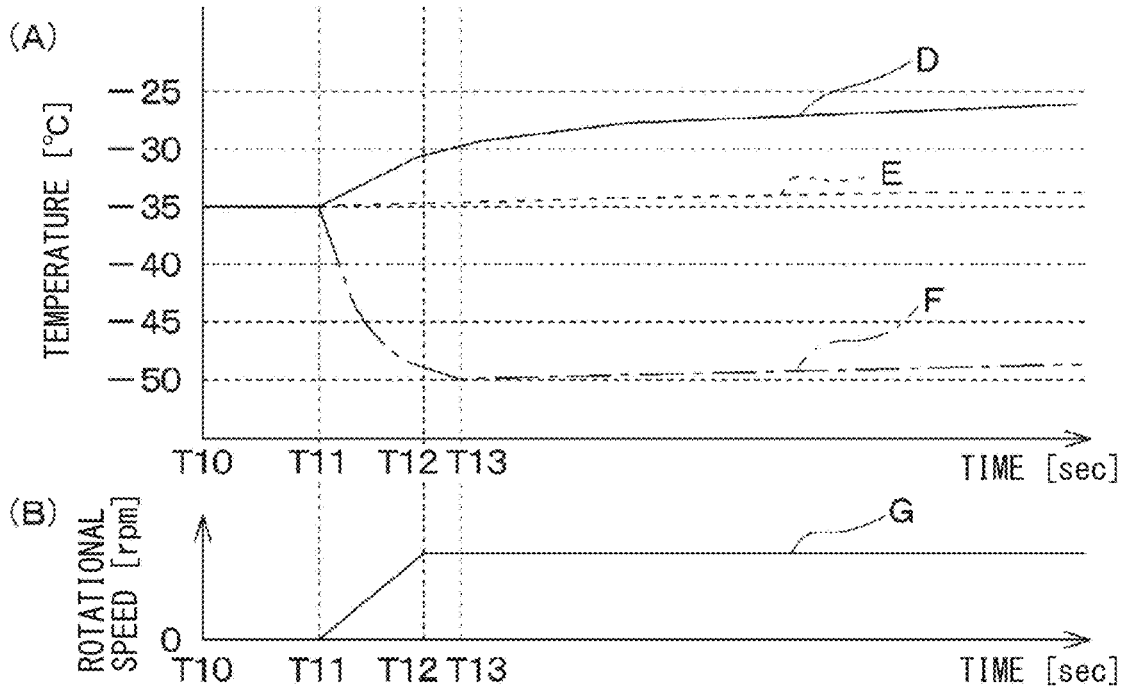
FIG. 5 is a graph showing a relationship between the temperature of a refrigerant and the temperature of an electronic component immediately after start-up of the electric compressor of the first embodiment under the extremely low ambient temperature environment.

FIGS. 4 and 5 are graphs showing a relationship between the temperature of the refrigerant (hereinafter, also referred to as the refrigerant temperature) and the temperature of the electronic component 27 immediately after the start-up of the electric compressor (i.e., immediately after the start-up of the refrigeration cycle apparatus 3) at the time of the space heating or the like using the thermal management system 2 during the extremely low outside air temperature (e.g., −35 degrees Celsius).

A solid line A in (A) of FIG. 4 and a solid line D in (A) of FIG. 5 respectively indicate the temperature of the corresponding electronic component 27, specifically the temperature of the switching device 58 of the inverter circuit in the corresponding electric control device 26. Furthermore, a dot-dash line B in (A) of FIG. 4 and a dot-dash line F in (A) of FIG. 5 respectively indicate the temperature of the refrigerant flowing in the refrigerant flow passage 25 of the corresponding electric compressor, i.e., the temperature of the refrigerant that is outputted from the low-temperature side refrigerant-coolant heat exchanger 9 of the refrigeration cycle apparatus 3 but has not yet been suctioned into the refrigerant compression unit 12. Furthermore, a dotted line E in (A) of FIG. 5 indicates the temperature of the coolant flowing in the coolant flow passage 20 of the electric compressor 1 of the first embodiment, i.e., the temperature of the coolant that is outputted from the high-temperature side coolant-air heat exchanger 16 of the first coolant circuit 4 but has not yet been flowed into the high-temperature side refrigerant-coolant heat exchanger 7. Additionally, a solid line C in (B) of FIG. 4 and a solid line G in (B) of FIG. 5 respectively indicate the rotational speed of the corresponding electric compressor 1.

FIG. 4 indicates the above-described information about the electric compressor of the comparative example. As shown in (A) of FIG. 4, a time period from a time point T0 to a time point T1 represents a state before the start-up of the electric compressor of the comparative example. During this period, the temperature of the electronic component 27 indicated by the solid line A and the temperature of the refrigerant indicated by the dot-dash line B are approximately the same as the outside air temperature (e.g., −35 degrees Celsius). As indicated by the solid line C in (B) of FIG. 4, the electric compressor starts its operation at the time point T1 (i.e., the refrigeration cycle starts its operation at the time point T1) and then operates at a constant rotational speed from a time point T2 onwards. At this time, as indicated by the dot-dash line B in (A) of FIG. 4, the refrigerant temperature largely decreases below the outside air temperature (decreasing to, for example, about −50 degrees Celsius) from the time point T1 to the time point T3, and then remains almost constant from the time point T3 onwards. This allows the refrigeration cycle apparatus 3 to absorb the heat from the outside air into the refrigerant.

In this case, as indicated by the solid line A in (A) of FIG. 4, the temperature of the electronic component 27 largely decreases below the outside air temperature (e.g., below −40 degrees Celsius) from the time point T1 to a time point T4, and then gradually increases from the time point T4 onwards. As described above, the temperature of the electronic component 27 largely decreases below the outside air temperature from the time point T1 to the time point T4 because the electronic component 27 exchanges the heat with the refrigerant, thereby resulting in the cooling of the electronic component 27 by the refrigerant. At that time, when the temperature of the electronic component 27 falls below a guaranteed lower temperature limit (e.g., −40 degrees Celsius) of the electronic component 27, there is a risk that the electronic component 27 fails. After the time point T4, the temperature of the electronic component 27 gradually increases due to self-heating caused by the energization of the electronic component 27.

FIG. 5 indicates the above-described information about the electric compressor 1 of the first embodiment. As shown in (A) of FIG. 5, a time period from a time point T10 to a time point T11 represents a state before the start-up of the electric compressor 1. During this period, the temperature of the electronic component 27 indicated by the solid line D, the temperature of the refrigerant indicated by the dot-dash line F and the temperature of the coolant indicated by the dotted line E are approximately the same as the outside air temperature (e.g., −35 degrees Celsius). As indicated by the solid line G in (B) of FIG. 5, the electric compressor 1 starts its operation at the time point T11 (i.e., the refrigeration cycle starts its operation at the time point T11) and then operates at a constant rotational speed from a time point T12 onwards. At this time, even at the electric compressor 1 of the first embodiment, similar to the electric compressor of the comparative example, as indicated by the dot-dash line F in (A) of FIG. 5, the refrigerant temperature largely decreases below the outside air temperature (decreasing to, for example, about −50 degrees Celsius) from the time point T11 to a time point T13, and then remains almost constant from the time point T13 onwards.

At that time, as indicated by the dotted line E in (A) of FIG. 5, the temperature of the coolant gradually increases from the outside air temperature from the time point T11 onwards. This is because the temperature of the coolant gradually increases as the refrigerant, which has the high temperature and the high pressure and is outputted after the compression process of the electric compressor 1, heats the coolant flowing in the first coolant circuit 4 through the high-temperature side refrigerant-coolant heat exchanger 7.

Furthermore, as indicated by the solid line D in (A) of FIG. 5, the temperature of the electronic component 27 gradually increases from the time point T11 onwards. This is because, in the electric compressor 1 of the first embodiment, the coolant flowing in the coolant flow passage 20 exchanges the heat with the electronic component 27 to limit the cooling of the electronic component 27 by the refrigerant, and the temperature of the electronic component 27 increases due to the self-heating thereof caused by the energization of the electronic component 27. Therefore, in the structure of the first embodiment, even if the refrigerant temperature largely decreases below the outside air temperature of the outdoor immediately after the start-up of the refrigeration cycle during the extremely low outside air temperature, the temperature of the electronic component 27 is limited from falling below the guaranteed lower temperature limit of the electronic component 27 because the coolant flowing in the coolant flow passage 20 exchanges the heat with the electronic component 27.

<Regarding Temperature of Windings 32 (Hereinafter, Referred to as Winding Temperature)>

Figure 6:
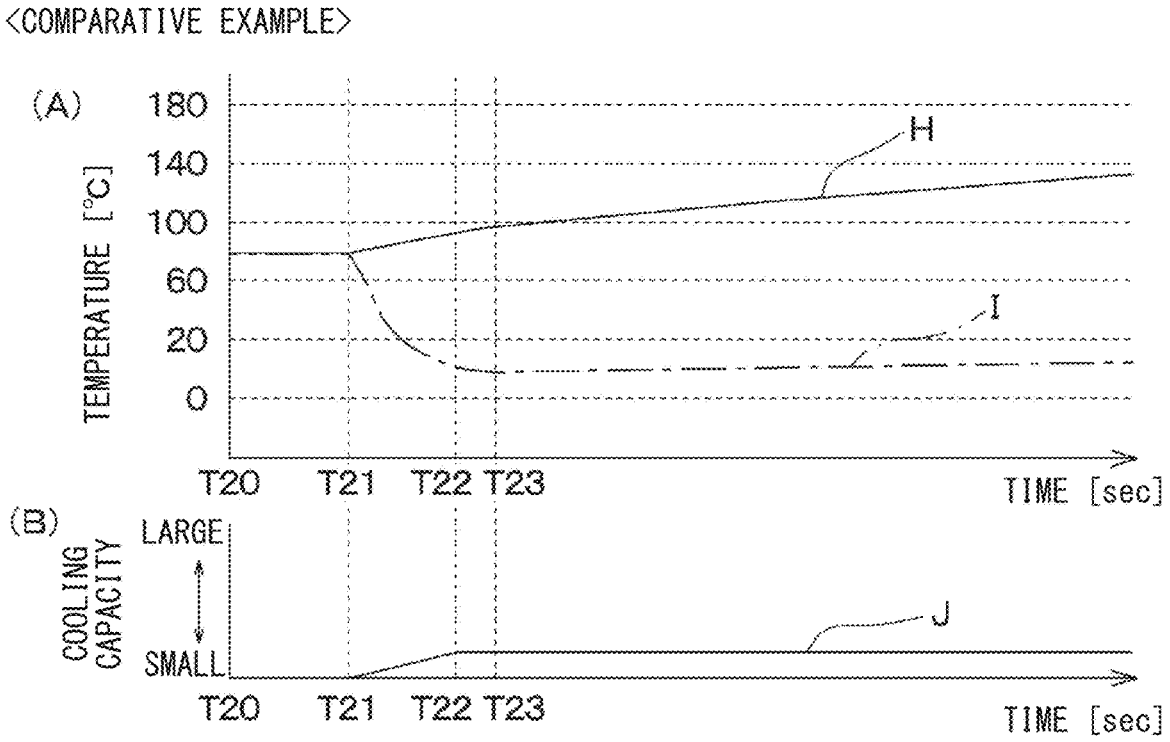
FIG. 6 is a graph showing a relationship between the temperature of windings of an electric motor and the temperature of the refrigerant under an operating condition of a low rotational speed and a high load in the electric compressor of the comparative example.
Figure 7:
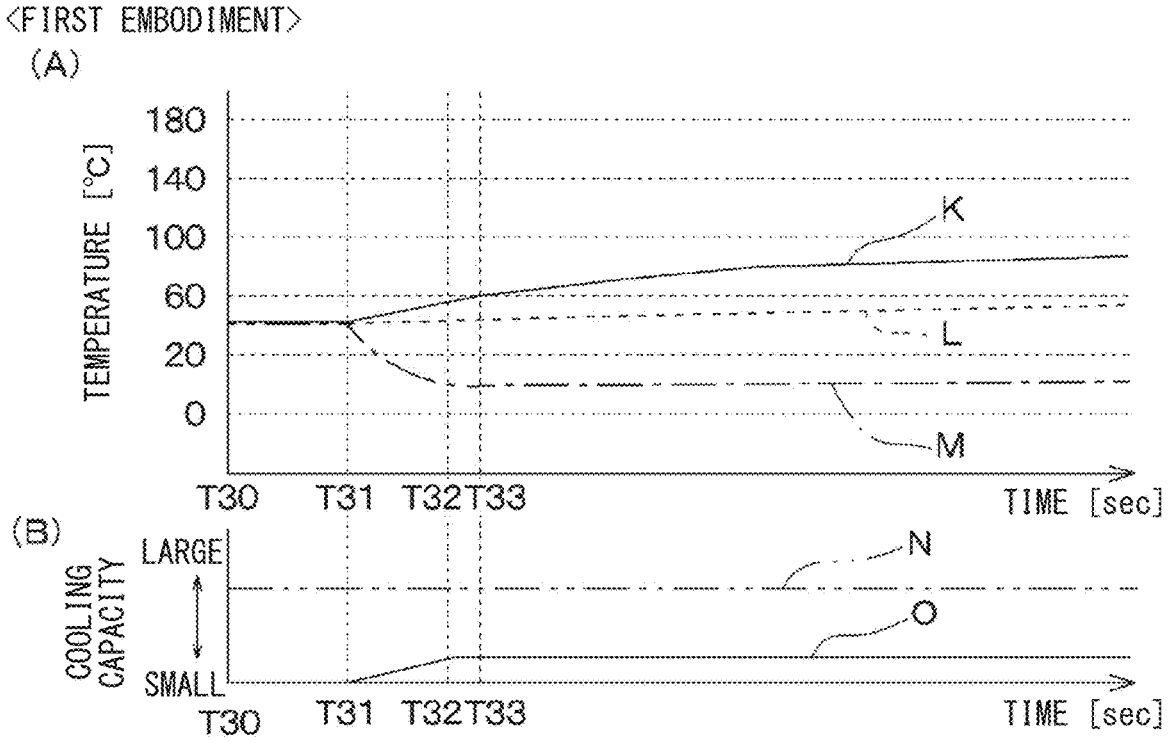
FIG. 7 is a graph showing a relationship between the temperature of windings of an electric motor and the temperature of the refrigerant under the operating condition of the low rotational speed and the high load in the electric compressor of the first embodiment.

Next, FIGS. 6 and 7 are graphs showing a relationship between the winding temperature of the electric motor 11 and the refrigerant temperature when the operating condition of the electric compressor 1 of the refrigeration cycle apparatus 3 is the low rotational speed and the high load.

A solid line H in (A) of FIG. 6 and a solid line K in (A) of FIG. 7 respectively indicate the winding temperature of the corresponding electric motor 11. Additionally, a dot-dash line I in (A) of FIG. 6 and a dot-dash line M in (A) of FIG. 7 respectively indicate the temperature of the refrigerant flowing in the refrigerant flow passage 25 of the corresponding electric compressor. Furthermore, a dotted line L in (A) of FIG. 7 indicates the temperature of the coolant flowing in the coolant flow passage 20 of the electric compressor 1 of the first embodiment.

Also, a solid line J in (B) of FIG. 6 and a solid line O in (B) of FIG. 7 respectively indicate a cooling capacity of the refrigerant flowing in the refrigerant flow passage 25 of the corresponding electric compressor. A dot-dot-dash line N in (B) of FIG. 7 indicates a cooling capacity of the coolant flowing in the coolant flow passage 20.

FIG. 6 indicates the above-described information about the electric compressor of the comparative example. As shown in (A) of FIG. 6, a time period from a time point T20 to a time point T21 represents a state before the start-up of the electric compressor of the comparative example. During this period, the temperature of the windings of the electric motor indicated by the solid line H and the temperature of the refrigerant indicated by a dot-dash line I are approximately the same as the outside air temperature (e.g., −35 degrees Celsius).

The electric compressor starts its operation at the time point T21 (i.e., the refrigeration cycle starts its operation at the time point T21) and then operates at a constant rotational speed from a time point T22 onwards. As indicated by the dot-dash line I in (A) of FIG. 6, the refrigerant temperature largely decreases below the outside air temperature from the time point T21 to a time point T23, and then remains almost constant from the time point T23 onwards. Therefore, as indicated by the solid line J in (B) of FIG. 6, the cooling capacity of the refrigerant flowing in the refrigerant flow passage 25 gradually increases from the time point T21 and becomes constant from the time point T22 onwards. However, since the operating condition of the electric compressor 1 is the low rotational speed operation, and the refrigerant flow rate is low, the cooling capacity of the refrigerant flowing in the refrigerant flow passage 25 is small.

At that time, as indicated by the solid line H in (A) of FIG. 6, the winding temperature gradually increases due to the self-heating caused by the energization of the windings 32 from the time point T21 onwards. At this time, since the operating condition of the electric compressor is the high load, the amount of electric current conducted through the respective windings 32 is large, and thereby the amount of self-heat generation of the windings 32 is large. However, as described above, due to the small cooling capacity of the refrigerant flowing in the refrigerant flow passage 25, the winding temperature may rise above a protection temperature (e.g., about 140 degrees Celsius) of the windings 32. In this case, the electric compressor of the comparative example must take measures such as changing the operating point of the electric compressor 1 or temporarily stopping or intermittently operating the electric compressor 1 to limit the winding temperature from rising above the protection temperature.

In contrast, FIG. 7 indicates the above-described information about the electric compressor 1 of the first embodiment. In the first embodiment, the first coolant circuit 4 is operating from before a time point T31 (i.e., before the start-up of the electric compressor 1). As shown in (A) of FIG. 7, a time period from a time point T30 to the time point T31 represents a state before the start-up of the electric compressor 1. During this period, the winding temperature indicated by the solid line K and the refrigerant temperature indicated by the dot-dash line M are approximately the same as the temperature of the coolant indicated by the dotted line L.

The electric compressor 1 starts its operation at the time point T31 (i.e., the refrigeration cycle starts its operation at the time point T31) and then operates at a constant rotational speed from the time point T32 onwards. As indicated by the dot-dash line M in (A) of FIG. 7, the refrigerant temperature decreases below the outside air temperature from the time point T31 to the time point T33, and then remains almost constant from the time point T33 onwards. Therefore, as indicated by the solid line O in (B) of FIG. 7, the cooling capacity of the refrigerant flowing in the refrigerant flow passage 25 gradually increases from the time point T31 and becomes constant from the time point T32 onwards. However, even in the first embodiment, since the operating condition of the electric compressor 1 is the low rotational speed operation, and the refrigerant flow rate is low, the cooling capacity of the refrigerant flowing in the refrigerant flow passage 25 is small.

On the other hand, as indicated by the dot-dot-dash line N in (B) of FIG. 7, in the first embodiment, since the amount of the coolant flowing in the first coolant circuit 4 is relatively large, the cooling capacity of the coolant flowing in the coolant flow passage 20 is larger than the cooling capacity of the refrigerant flowing in the refrigerant flow passage 25.

At that time, as indicated by the solid line K in (A) of FIG. 7, the winding temperature gradually increases from the time point T31 onwards. Even in the first embodiment, since the operating condition of the electric compressor 1 is the high load, the amount of electric current conducted through the respective windings 32 is large, and thereby the amount of self-heat generation of the windings 32 is large. In contrast, since the operating condition of the electric compressor 1 is the low rotational speed operation, and the refrigerant flow rate is low, the cooling capacity of the refrigerant flowing in the refrigerant flow passage 25 is small. However, in the first embodiment, the heat exchange takes place among the coolant flowing in the coolant flow passage 20, the windings 32, and the refrigerant flowing in the refrigerant flow passage 25. As a result, the windings 32 are sufficiently cooled by the coolant flowing in the coolant flow passage 20, limiting the temperature of the windings 32 from rising above the protection temperature thereof. Therefore, in the first embodiment, it is possible to suppress the occurrence of the limiting the operating range of the electric compressor 1 for the purpose of protecting the windings 32 imposed due to the insufficient cooling of the windings 32 by the refrigerant at the time of operating the electric compressor 1 at the low rotational speed and the high load.

Figure 8:
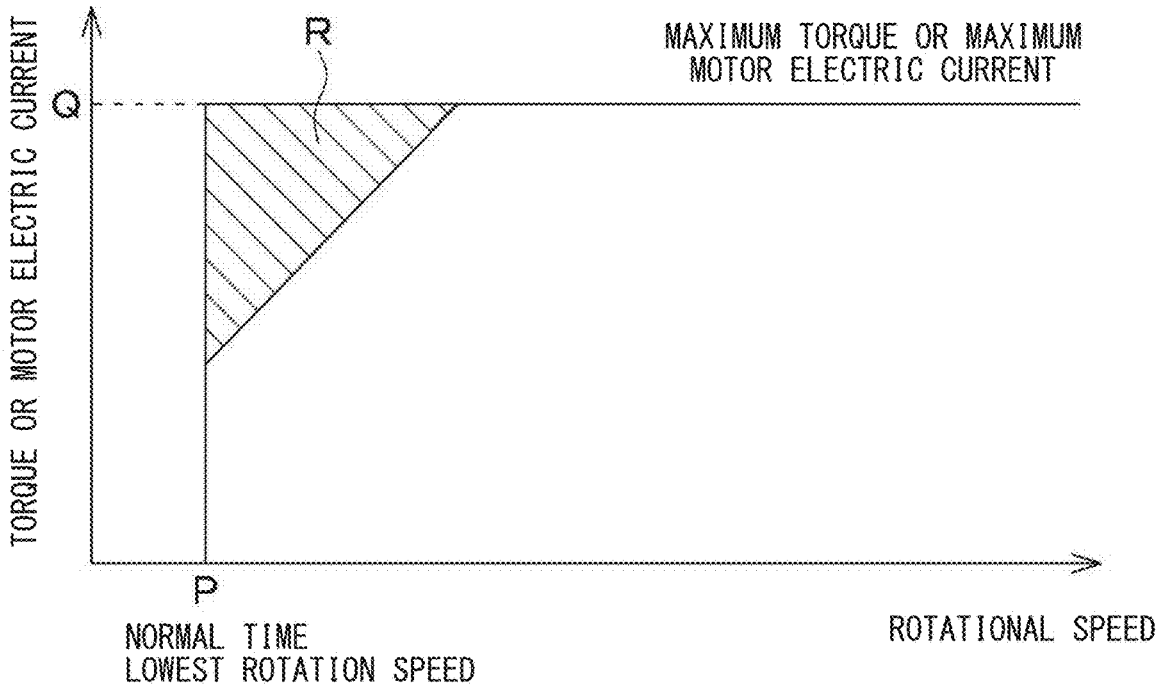
FIG. 8 is a graph for explaining an operating range of the electric compressor.

Now, the operating range of the electric compressor 1 will be described with reference to FIG. 8.

The operating range of the electric compressor 1 refers to an operable range expressed by, for example, the rotational speed and the torque of the electric motor 11, or the rotational speed and the motor electric current (i.e., the electric current supplied to the electric motor 11). In FIG. 8, the horizontal axis represents the rotational speed, and the vertical axis represents the torque or motor electric current. A reference sign P on the horizontal axis indicates a minimum rotational speed of the electric motor 11 during steady-state operation of the electric motor 11. A reference sign Q on the vertical axis indicates a maximum torque or a maximum motor electric current. Therefore, the electric compressor 1 operates within an operating range that is equal to or greater than P and equal to or less than Q.

As the rotational speed of the electric compressor 1 increases, the cooling performance of the refrigerant in the refrigerant flow passage 25 improves. Furthermore, as the rotational speed of the electric compressor 1 decreases, the cooling performance of the refrigerant in the refrigerant flow passage 25 decreases. The electric compressor of the comparative example described above does not have the coolant flow passage 20 in the housing 19 and is configured to cool the electric motor 11 only with the refrigerant in the refrigerant flow passage 25. Therefore, in the case of the electric compressor of the comparative example, in the operating range where the rotational speed of the electric motor 11 is low, i.e., in the range where the cooling performance of the refrigerant in the refrigerant flow passage 25 is low, when the torque or the motor electric current is high, there is a disadvantage that the winding temperature of the electric motor 11 rises above the protection temperature. This results in a limitation of the operating area, such that a hatched area shown in the upper left of FIG. 8 (hereinafter referred to as an operating range R) cannot be used. Therefore, in terms of the performance of the refrigeration cycle, it is preferable that the operation in the operating range R is possible. However, if this is not possible, measures such as increasing of the rotational speed and performing of the intermittent operation are necessary.

In contrast, the electric compressor 1 of the first embodiment is configured to cool the electric motor 11 using both the refrigerant flow passage 25 and the coolant flow passage 20 provided in the housing 19. As a result, the electric compressor of the first embodiment can maintain the winding temperature of the electric motor 11 and expand the operating range by using the cooling with the coolant flow passage 20 to address the issue of insufficient cooling of the electric motor 11 at the low rotational speed that occurs with the electric compressor of the comparative example, which relies solely on the refrigerant cooling.

<Control Processes Executed by ECU 6>

Next, the control processes executed by the ECU 6 of the thermal management system 2 will be explained with reference to flowcharts shown in FIGS. 9 and 10.

Figure 9:
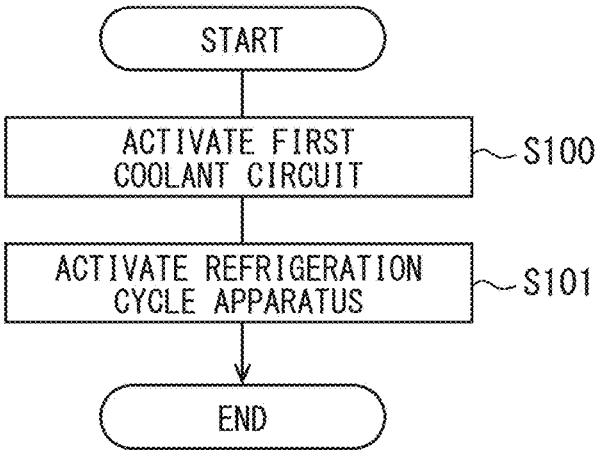
FIG. 9 is a flowchart illustrating an example of control processes executed by an electronic controller device during the start-up of the thermal management system.

FIG. 9 shows an example of the control processes executed by the ECU 6 during the start-up of the thermal management system 2.

First, in step S100, the ECU 6 activates the first coolant circuit 4. Specifically, the ECU 6 activates the first coolant pump 17, which is installed in the first coolant circuit 4.

Next, in step S101, the ECU 6 activates the refrigeration cycle apparatus 3. Specifically, the ECU 6 activates the first coolant pump 17 and then activates the electric compressor 1 of the refrigeration cycle apparatus 3 after a predetermined time period has elapsed from the activation of the first coolant pump 17.

This allows the heat exchange between: the coolant flowing in the coolant flow passage 20; and the electronic components 27 and the windings 32, before the start-up of the refrigeration cycle apparatus 3. The predetermined time period in step S101 is a time period that enables the heat exchange between: the coolant flowing in the coolant flow passage 20; and the electronic components 27 and the windings 32. This time period is set based on experiments and is stored in the ECU 6.

Figure 10:
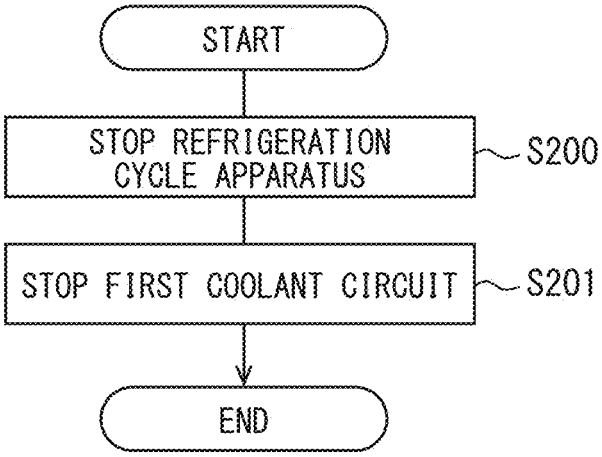
FIG. 10 is a flowchart illustrating an example of control processes executed by the electronic controller device during the shutdown of the thermal management system.

In contrast, FIG. 10 shows an example of the control processes executed by the ECU 6 during a shutdown period of the thermal management system 2.

First, in step S200, the ECU 6 deactivates the refrigeration cycle apparatus 3. Specifically, the ECU 6 deactivates the electric compressor 1 of the refrigeration cycle apparatus 3.

Next, in step S201, the ECU 6 deactivates the first coolant circuit 4. Specifically, the ECU 6 deactivates the electric compressor 1 and then deactivates the first coolant pump 17 installed in the first coolant circuit 4 after a predetermined time period has elapsed from the deactivation of the electric compressor 1.

This allows the heat exchange between: the coolant flowing in the coolant flow passage 20; and the electronic components 27 and the windings 32, even after the deactivation of the refrigeration cycle apparatus 3. The predetermined time period in step S201 is also a time period that enables the heat exchange between: the coolant flowing in the coolant flow passage 20; and the electronic components 27 and the windings 32. This time period is set based on experiments and is stored in the ECU 6.

The electric compressor 1 and the thermal management system 2 of the first embodiment described above have the following effects and advantages.

(1) The electric compressor 1 of the first embodiment has the refrigerant flow passage 25 and the coolant flow passage 20 at the inside of the housing 19. The refrigerant flow passage 25 is configured to enable the exchange of the heat between: the refrigerant, which flows in the refrigerant flow passage 25 before being suctioned into the refrigerant compression unit 12 and has the low temperature and the low pressure; and the windings 32 and the electronic components 27. The coolant flow passage 20 is configured to enable the exchange of the heat between: the coolant, which flows in the coolant flow passage 20; and the windings 32 and the electronic components 27.

Accordingly, the windings 32 and the electronic components 27 can exchange the heat with the refrigerant flowing in the refrigerant flow passage 25 and with the coolant flowing in the coolant flow passage 20. Therefore, when using the refrigeration cycle apparatus 3 for the space heating or the like during the extremely low outside air temperature, even in the case where the refrigerant temperature drops below the guaranteed lower temperature limit of the electronic component 27, the heat exchange between the coolant and the electronic component 27 can limit the temperature of the electronic component 27 from falling below the guaranteed lower temperature limit.

Furthermore, with respect to the operating condition of the refrigeration cycle apparatus 3, when the electric compressor 1 is operating at the low rotational speed and the high load, the refrigerant flow rate decreases, and thereby the cooling capacity of the refrigerant for cooling the windings 32 is reduced. Even at that time, the heat exchange between the coolant and the windings 32 can limit the temperature of the windings 32 from rising above its protection temperature. Therefore, it is possible to suppress the need for the control that limits the rising of the temperature of the windings 32 above the protection temperature of the windings 32 by changing the operating point of the electric compressor 1 or temporarily stopping or intermittently operating the electric compressor 1. Thus, the occurrence of limiting the operating range of the electric compressor 1 can be suppressed.

Furthermore, in general, a temperature difference between the temperature of the coolant flowing in the coolant flow passage 20 at the low temperature time and the temperature of the coolant flowing in the coolant flow passage 20 at the high temperature time is smaller than a temperature difference between the temperature of the refrigerant flowing in the refrigerant flow passage 25 at the low temperature time and the temperature of the refrigerant flowing in the refrigerant flow passage 25 at the high temperature time. Therefore, by configuring the structure such that the coolant flowing in the coolant flow passage 20 and the electronic components 27 exchange the heat, it is possible to limit the temperature change of the respective electronic components 27. Therefore, it is possible to extend the lifespan of the respective electronic components 27.

(2) In the first embodiment, the refrigerant flow passage 25 is configured to conduct the refrigerant at least between the stator 28 and the rotor 29 of the electric motor 11. Thus, the refrigerant flow passage 25 enables the exchange of the heat directly between the refrigerant flowing in the refrigerant flow passage 25 and the electric motor 11 and also enable the exchange of the heat between the refrigerant flowing in the refrigerant flow passage 25 and the electronic components 27 through the housing 19.

The through-hole, which forms the coolant flow passage 20, is formed at a corresponding location of the housing 19 which is between the electric motor 11 and the electric control device 26. Therefore, the coolant flowing in the coolant flow passage 20 can exchange the heat with the electric motor 11 and the electronic components 27 through the housing 19.

Accordingly, the windings 32 and the electronic components 27 can exchange the heat with the refrigerant flowing in the refrigerant flow passage 25 and with the coolant flowing in the coolant flow passage 20.

(3) In the first embodiment, each of the electronic components 27 (e.g., the filter 57 and the switching devices 58), which are configured to generate the heat in response to the energization thereof, is positioned closer to the coolant flow passage 20 than the center location CP of the electric control device 26.

Accordingly, it is possible to enhance the heat exchange efficiency between these electronic components 27, which generate the heat in response to the energization thereof, and the coolant, compared to the heat exchange efficiency between other component(s), which is other than the electronic components 27 described above and are within the electric control device 26, and the coolant. Additionally, this can limit the temperature change of the respective electronic components 27, thereby extending the lifespan thereof.

(4) In the thermal management system 2 of the first embodiment, the coolant flow passage 20 of the electric compressor 1 is a flow passage that is configured to conduct the coolant from the high-temperature side coolant-air heat exchanger 16 to the high-temperature side refrigerant-coolant heat exchanger 7.

Accordingly, the coolant flowing from the high-temperature side coolant-air heat exchanger 16 to the high-temperature side refrigerant-coolant heat exchanger 7 is the coolant that has released the heat to the air at the high-temperature side coolant-air heat exchanger 16 and absorbs the heat from the refrigerant at the high-temperature side refrigerant-coolant heat exchanger 7. Therefore, by using the coolant on the upstream side of the high-temperature side refrigerant-coolant heat exchanger 7, compared to using the coolant on the downstream side of the high-temperature side refrigerant-coolant heat exchanger 7, it is possible to enhance the cooling efficiency of the windings 32 by the coolant and increase the amount of heat absorption from the windings 32 by the coolant. Therefore, in addition to the cooling of the windings 32, it is possible to enhance the efficiency of the thermal management system 2 by increasing the temperature of the coolant circulating in the coolant circuit.

(5) The ECU 6 of the thermal management system 2 of the first embodiment is configured to activate the first coolant pump 17 at the time that is in advance of activation of the electric compressor 1 by the predetermined time period. Furthermore, this ECU 6 is configured to deactivate the first coolant pump 17 at the time that is after elapse of the predetermined time period from the time of deactivation of the electric compressor 1.

Accordingly, by activating the first coolant pump 17 at the time that is in advance of the activation of the electric compressor 1 by the predetermined time period, the heat exchange is possible between the coolant flowing in the coolant flow passage 20 and the electronic components 27 and the windings 32 before the start-up of the refrigeration cycle apparatus 3.

Furthermore, by deactivating the first coolant pump 17 after the predetermined time has elapsed since the time of deactivation of the electric compressor 1, the heat exchange is possible between the coolant flowing in the coolant flow passage 20 and the windings 32 and the electronic components 27 even after the deactivation of the refrigeration cycle apparatus 3 or temporarily pausing of the operation of the refrigeration cycle apparatus 3.

Therefore, when using the refrigeration cycle apparatus 3 for the space heating or the like during the extremely low outside air temperature, even in the case where the refrigerant temperature drops below the guaranteed lower temperature limit of the electronic component 27, the heat exchange between the coolant and the electronic component 27 can limit the temperature of the electronic component 27 from falling below the guaranteed lower temperature limit.

Even after the operation of the refrigeration cycle apparatus 3 is stopped or during the temporary pausing of the operation of the refrigeration cycle apparatus 3, the windings 32 and the electronic components 27 can be cooled through the heat exchange between the coolant and the windings 32 and the electronic components 27. Therefore, the occurrence of limiting the operating range of the electric compressor 1 can be suppressed.

Second Embodiment

Next, the second embodiment will be described. The second embodiment describes an example of the control processes executed by the ECU 6 of the thermal management system 2. Since the rest of the second embodiment is the same as in the first embodiment, only portions, which are different from the first embodiment, will be explained.

The control processes executed by the ECU 6 of the thermal management system 2 of the second embodiment will be explained with reference to a flowchart of FIG. 11. This operation is repeatedly executed during the operation of the thermal management system 2.

Figure 11:
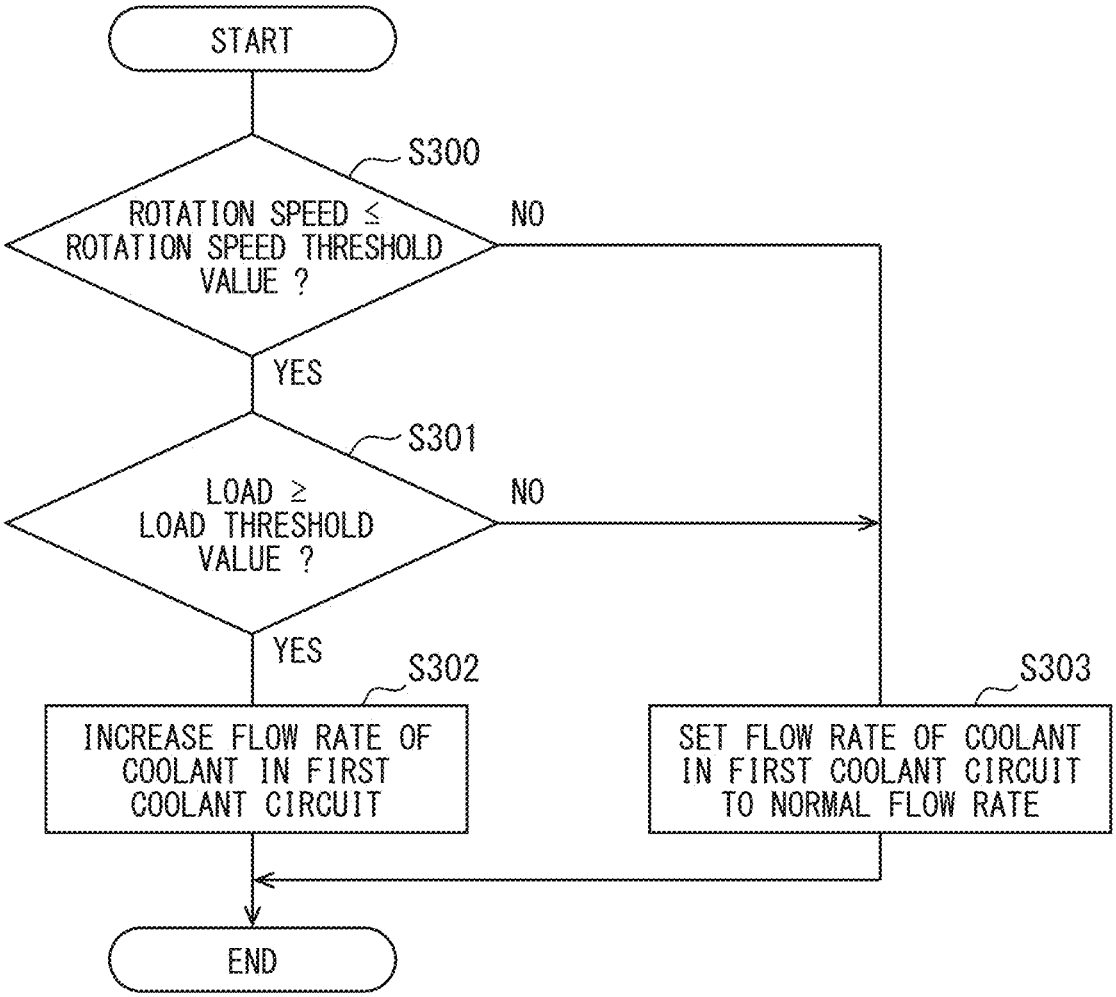
FIG. 11 is a flowchart illustrating an example of control processes executed by the electronic controller device during the shutdown of the thermal management system of a second embodiment.

In step S300 of FIG. 11, the ECU 6 determines whether the rotational speed of the electric compressor 1 of the refrigeration cycle apparatus 3 is equal to or lower than a predetermined rotational speed threshold value. When it is determined that the rotational speed of the electric compressor 1 is equal to or lower than the predetermined rotational speed threshold value, the operation proceeds to step S301.

In step S301, the ECU 6 determines whether the load on the electric compressor 1 of the refrigeration cycle apparatus 3 is equal to or higher than a predetermined load threshold value. When it is determined that the load on the electric compressor 1 is equal to or higher than the predetermined load threshold value, the operation proceeds to step S302.

In step S302, the ECU 6 executes control to increase the flow rate of the coolant in the first coolant circuit 4 by, for example, increasing the rotational speed of the first coolant pump 17 in the first coolant circuit 4.

In contrast, when it is determined that the rotational speed of the electric compressor 1 is higher than the predetermined rotational speed threshold value in step S300, the operation proceeds to step S303. Furthermore, when it is determined that the load on the electric compressor 1 is lower than the predetermined load threshold value in step S301, the operation also proceeds to step S303.

In step S303, the ECU 6 executes control to normalize the flow rate of the coolant in the first coolant circuit 4 by, for example, setting the rotational speed of the first coolant pump 17 to its normal value.

In the second embodiment described above, the ECU 6 of the thermal management system 2 executes the control to increase the flow rate of the coolant in the first coolant circuit 4 when the electric compressor 1 operates at the rotational speed equal to or lower than the predetermined rotational speed threshold value and at the load higher than the predetermined load threshold value.

Accordingly, at the operating condition of the low rotational speed and the high load of the electric compressor 1, which poses a thermal resistance challenge for the electric compressor 1, the cooling effect of the coolant flowing in the coolant flow passage 20 of the electric compressor 1 can be further enhanced by increasing the cooling capacity of the first coolant circuit 4.

First Modification of Second Embodiment

In the description of the above second embodiment, the ECU 6 determines in step S301 whether the load on the electric compressor 1 of the refrigeration cycle apparatus 3 is equal to or higher than the predetermined load threshold value, but the present disclosure is not limited to that.

For example, instead of the process in step S301, the ECU 6 may determine whether a pressure (hereinafter, referred to as a refrigerant pressure) of the refrigerant discharged from the electric compressor 1 is equal to or higher than a predetermined pressure threshold value. When it is determined that the refrigerant pressure is equal to or higher than the predetermined pressure threshold value, the ECU 6 proceeds to step S302. In contrast, when it is determined that the refrigerant pressure is lower than the predetermined pressure threshold value, the ECU 6 proceeds to step S303. Even with this modification, the effects and advantages, which are similar to those of the second embodiment, can be achieved.

Second Modification of Second Embodiment

For example, instead of the operation in step S301, the ECU 6 may determine whether the electric current supplied to the electric motor 11 is equal to or higher than a predetermined electric current threshold value. When it is determined that the electric current supplied to the electric motor 11 is equal to or higher than the predetermined electric current threshold value, the ECU 6 proceeds to step S302. When it is determined that the electric current supplied to the electric motor 11 is lower than the predetermined electric current threshold value, the ECU 6 proceeds to step S303. Even with this modification, the effects and advantages, which are similar to those of the second embodiment, can be achieved.

Third Embodiment

The third embodiment will be described. The third embodiment describes an example of the control processes executed by the ECU 6 of the thermal management system 2. Since the rest of the third embodiment is the same as in the first embodiment, only portions, which are different from the first embodiment, will be explained.

In the third embodiment, the ECU 6 may mediate between the refrigeration cycle apparatus 3 and the first coolant circuit 4, and control the condition so that the electric motor 11 and the electronic components 27 of the electric control device 26 are properly cooled.

In the condition of the extremely low outside air temperature, for example, the control of the refrigeration cycle apparatus 3 is adjusted so that the temperature of the refrigerant flowing out from the low-temperature side refrigerant-coolant heat exchanger 9 and being suctioned into the refrigerant compression unit 12 of the electric compressor 1 increases. Additionally, for example, before the operation of the refrigeration cycle apparatus 3, the temperature of the coolant flowing in the coolant flow passage 20 is adjusted to be above a predetermined temperature. These controls enable the electric control device 26 and the electric motor 11 to be maintained at the appropriate temperature even under the condition of the extremely low outside air temperature.

On the other hand, under the condition where the protection temperature of the windings 32 of the electric motor 11 at the time of operating the electric compressor 1 at the low rotational speed and the high load becomes the issue, the control of the refrigeration cycle apparatus 3 is adjusted, for example, so that the temperature of the refrigerant flowing out from the low-temperature side refrigerant-coolant heat exchanger 9 and being suctioned into the refrigerant compression unit 12 of the electric compressor 1 decreases. Additionally, for example, the control of the refrigeration cycle apparatus 3 is adjusted so that the cooling performance of the electric motor 11 by the refrigerant is improved by slightly increasing the rotational speed of the electric compressor 1. Furthermore, for example, the control of the first coolant circuit 4 is adjusted so that the heat releasing capacity of the coolant is increased by the high-temperature side coolant-air heat exchanger 16, thereby lowering the temperature of the coolant flowing in the coolant flow passage 20 and improving the cooling performance of the electric motor 11 by the coolant. Furthermore, for example, the control of the first coolant circuit 4 is adjusted so that the flow rate of the coolant flowing in the coolant flow passage 20 is increased, thereby improving the cooling performance of the electric motor 11 by the coolant. These controls enable the electric motor 11 and the electric control device 26 to be maintained at the appropriate temperatures when the protection temperature of the windings 32 at the time of operating the electric compressor 1 at the low rotational speed and the high load becomes the issue.

Other Embodiments (1) In the respective embodiments described above, the electric compressor 1 includes the housing 19, the refrigerant flow passage 25, the coolant flow passage 20, the electric motor 11, the refrigerant compression unit 12 and the electric control device 26. However, the present disclosure is not limited to this configuration. For example, in addition to the configuration described above, the electric compressor 1 may further include various components (e.g., a liquid reservoir, an oil separator and the like) of the refrigeration cycle apparatus integrated with the configuration described above.

(2) In the respective embodiments described above, it has been described that the ECU 6 controls the driving of the electric compressor 1, the first coolant pump 17 and the second coolant pump 23 included in the thermal management system 2, but the present disclosure is not limited to this configuration. For example, the driving of the electric compressor 1, the first coolant pump 17 and the second coolant pump 23 may be controlled by the electric control device 26 included in the electric compressor 1, or may be controlled by another electronic controller device.

The present disclosure is not limited to the embodiments described above, and the embodiments described above may be appropriately modified. Further, the embodiments described above are not unrelated to each other and can be appropriately combined unless the combination is clearly impossible. Needless to say, in each of the embodiments described above, the elements of the embodiment are not necessarily essential except when it is clearly indicated that they are essential and when they are clearly considered to be essential in principle. In each of the embodiments described above, when a numerical value such as the number, numerical value, amount, range or the like of the constituent elements of the embodiment is mentioned, the present disclosure should not be limited to such a numerical value unless it is clearly stated that it is essential and/or it is required in principle. In each of the embodiments described above, when the shape, the positional relationship or the like of the constituent elements of the embodiment are mentioned, the present disclosure should not be limited the shape, the positional relationship or the like unless it is clearly stated that it is essential and/or it is required in principle.

The controller device and its control method of the present disclosure may be realized by a dedicated computer that is provided by configuring at least one processor and a memory programmed to perform one or more functions embodied by a computer program. Alternatively, the controller device and its control method of the present disclosure may be realized by a dedicated computer that is provided by configuring at least one processor with one or more dedicated hardware logic circuits. Further alternatively, the controller device and its control method of the present disclosure may be realized by one or more dedicated computers that are provided by configuring a combination of: a processor programmed to perform one or more functions and a memory; and a processor composed of one or more hardware logic circuits. Further, the computer program may also be stored in a computer-readable, non-transitory, tangible storage medium as instructions to be executed by a computer.

Aspects of Present Disclosure

The present disclosure described above can be understood as the following aspects, for example.

(First Aspect)

According to a first aspect, there is provided an electric compressor for a refrigeration cycle apparatus, the electric compressor including:

- a housing that forms an outer shell of the electric compressor;
- an electric motor that is installed at an inside of the housing and is configured to be rotated in response to energization of a plurality of windings of the electric motor;
- a refrigerant compression unit that is configured to be driven by the electric motor so as to suction a refrigerant and discharge the refrigerant after compressing the refrigerant;
- an electric control device that includes an electronic component which is configured to generate heat in response to energization of the electronic component, wherein the electric control device is configured to control the energization of the plurality of windings of the electric motor;

a refrigerant flow passage that is formed at the inside of the housing, wherein the refrigerant flow passage is configured to enable exchange of heat between:

the refrigerant, which flows in the refrigerant flow passage before being suctioned into the refrigerant compression unit and has a low temperature and a low pressure; and the electric motor and the electric control device; and a coolant flow passage that is formed at the inside of the housing, wherein the coolant flow passage is configured to enable exchange of heat between:

a coolant, which flows in the coolant flow passage; and the electric motor and the electric control device.

(Second Aspect)

According to a second aspect, there is provided the electric compressor according to the first aspect, wherein:

the refrigerant flow passage is configured to conduct the refrigerant at least between a stator and a rotor of the electric motor so as to enable the exchange of the heat directly between the refrigerant in the refrigerant flow passage and the electric motor and also enable the exchange of the heat between the refrigerant in the refrigerant flow passage and the electric control device through the housing; and the coolant flow passage is configured to conduct the coolant through a hole, which is formed in the housing between the electric motor and the electric control device, wherein the coolant flow passage is configured to enable the exchange of the heat through the housing between:

the coolant in the coolant flow passage; and the electric motor and the electric control device.

(Third Aspect)

According to a third aspect, there is provided the electric compressor according to the first aspect or the second aspect, wherein the electronic component, which is configured to generate the heat in response to the energization of the electronic component, is positioned closer to the coolant flow passage than a center location of the electric control device.

(Fourth Aspect)

According to a fourth aspect, there is provided a thermal management system including:

a refrigeration cycle apparatus that is configured to circulate the refrigerant among:

the electric compressor of claim 1;

a high-temperature side refrigerant-coolant heat exchanger, which is configured to exchange heat between the refrigerant discharged from the refrigerant compression unit of the electric compressor and the coolant;

an expansion valve, which is configured to decompress and expand the refrigerant outputted from the high-temperature side refrigerant-coolant heat exchanger; and a low-temperature side refrigerant-heat medium heat exchanger, which is configured to exchange heat between the refrigerant outputted from the expansion valve and a heat medium, wherein the electric compressor, the high-temperature side refrigerant-coolant heat exchanger, the expansion valve and the low-temperature side refrigerant-heat medium heat exchanger are connected through a refrigerant pipeline to circulate the refrigerant in the refrigeration cycle apparatus; and a coolant circuit that is configured to circulate the coolant among:

a high-temperature side coolant-air heat exchanger, which is configured to exchange heat between air and the coolant;

the high-temperature side refrigerant-coolant heat exchanger; and a coolant pump, wherein the high-temperature side coolant-air heat exchanger, the high-temperature side refrigerant-coolant heat exchanger and the coolant pump are connected through a coolant pipeline to circulate the coolant in the coolant circuit, wherein:

the coolant flow passage of the electric compressor is a flow passage that is configured to conduct the coolant from the high-temperature side coolant-air heat exchanger to the high-temperature side refrigerant-coolant heat exchanger.

(Fifth Aspect)

According to a fifth aspect, there is provided the thermal management system according to claim 4, comprising an electronic controller device that is configured to control an operation of the coolant pump and an operation of the electric compressor, wherein:

the electronic controller device is configured to activate the coolant pump at a time that is in advance of activation of the electric compressor by a predetermined time period; and the electronic controller device is configured to deactivate the coolant pump at a time that is after elapse of a predetermined time period from a time of deactivation of the electric compressor.

What is claimed is:

1. A thermal management system comprising:

a refrigeration cycle apparatus that is configured to circulate a refrigerant among:

an electric compressor;

a high-temperature side refrigerant-coolant heat exchanger, which is configured to exchange heat between the refrigerant discharged from a refrigerant compression unit of the electric compressor and a coolant;

an expansion valve, which is configured to decompress and expand the refrigerant outputted from the high-temperature side refrigerant-coolant heat exchanger; and a low-temperature side refrigerant-heat medium heat exchanger, which is configured to exchange heat between the refrigerant outputted from the expansion valve and a heat medium, wherein the electric compressor, the high-temperature side refrigerant-coolant heat exchanger, the expansion valve and the low-temperature side refrigerant-heat medium heat exchanger are connected through a refrigerant pipeline to circulate the refrigerant in the refrigeration cycle apparatus; and a coolant circuit that is configured to circulate the coolant among:

a high-temperature side coolant-air heat exchanger, which is configured to exchange heat between air and the coolant;

the high-temperature side refrigerant-coolant heat exchanger; and a coolant pump, wherein the high-temperature side coolant-air heat exchanger, the high-temperature side refrigerant-coolant heat exchanger and the coolant pump are connected through a coolant pipeline to circulate the coolant in the coolant circuit; and an electronic controller device that is configured to control an operation of the coolant pump and an operation of the electric compressor, wherein:

the electric compressor includes:

a housing that forms an outer shell of the electric compressor;

an electric motor that is installed at an inside of the housing and is configured to be rotated in response to energization of a plurality of windings of the electric motor;

the refrigerant compression unit that is configured to be driven by the electric motor so as to suction the refrigerant and discharge the refrigerant after compressing the refrigerant;

an electric control device that includes an electronic component which is configured to generate heat in response to energization of the electronic component, wherein the electric control device is configured to control the energization of the plurality of windings of the electric motor;

a refrigerant flow passage that is formed at the inside of the housing, wherein the refrigerant flow passage is configured to enable exchange of heat between:

the refrigerant, which flows in the refrigerant flow passage before being suctioned into the refrigerant compression unit and has a low temperature and a low pressure; and the electric motor and the electric control device; and a coolant flow passage that is formed at the inside of the housing, wherein the coolant flow passage is configured to enable exchange of heat between:

the coolant, which flows in the coolant flow passage; and the electric motor and the electric control device;

the coolant flow passage of the electric compressor is a flow passage that is configured to conduct the coolant from the high-temperature side coolant-air heat exchanger to the high-temperature side refrigerant-coolant heat exchanger;

the electronic controller device is configured to activate the coolant pump at a time that is in advance of activation of the electric compressor by a predetermined time period; and the electronic controller device is configured to deactivate the coolant pump at a time that is after elapse of a predetermined time period from a time of deactivation of the electric compressor.

2. The thermal management system according to claim 1, wherein:

the refrigerant flow passage is configured to conduct the refrigerant at least between a stator and a rotor of the electric motor so as to enable the exchange of the heat directly between the refrigerant in the refrigerant flow passage and the electric motor and also enable the exchange of the heat between the refrigerant in the refrigerant flow passage and the electric control device through the housing; and the coolant flow passage is configured to conduct the coolant through a hole, which is formed in the housing between the electric motor and the electric control device, wherein the coolant flow passage is configured to enable the exchange of the heat through the housing between:

the coolant in the coolant flow passage; and the electric motor and the electric control device.

3. The thermal management system according to claim 1, wherein the electronic component, which is configured to generate the heat in response to the energization of the electronic component, is positioned closer to the coolant flow passage than a center location of the electric control device.

4. A thermal management system comprising:

a refrigeration cycle apparatus that is configured to circulate a refrigerant among:

an electric compressor;

a high-temperature side refrigerant-coolant heat exchanger, which is configured to exchange heat between the refrigerant discharged from a refrigerant compression unit of the electric compressor and a coolant;

an expansion valve, which is configured to decompress and expand the refrigerant outputted from the high-temperature side refrigerant-coolant heat exchanger; and a low-temperature side refrigerant-heat medium heat exchanger, which is configured to exchange heat between the refrigerant outputted from the expansion valve and a heat medium, wherein the electric compressor, the high-temperature side refrigerant-coolant heat exchanger, the expansion valve and the low-temperature side refrigerant-heat medium heat exchanger are connected through a refrigerant pipeline to circulate the refrigerant in the refrigeration cycle apparatus; and a coolant circuit that is configured to circulate the coolant among:

a high-temperature side coolant-air heat exchanger, which is configured to exchange heat between air and the coolant;

the high-temperature side refrigerant-coolant heat exchanger; and a coolant pump, wherein the high-temperature side coolant-air heat exchanger, the high-temperature side refrigerant-coolant heat exchanger and the coolant pump are connected through a coolant pipeline to circulate the coolant in the coolant circuit; and a controller that is configured to control an operation of the coolant pump and an operation of the electric compressor, wherein:

the electric compressor includes:

a housing that forms an outer shell of the electric compressor;

an electric motor that is installed at an inside of the housing and is configured to be rotated in response to energization of a plurality of windings of the electric motor;

the refrigerant compression unit that is configured to be driven by the electric motor so as to suction the refrigerant and discharge the refrigerant after compressing the refrigerant;

an electric control circuitry that includes an electronic component which is configured to generate heat in response to energization of the electronic component, wherein the electric control circuitry is configured to control the energization of the plurality of windings of the electric motor;

a refrigerant flow passage that is formed at the inside of the housing, wherein the refrigerant flow passage is configured to enable exchange of heat between:

the refrigerant, which flows in the refrigerant flow passage before being suctioned into the refrigerant compression unit and has a low temperature and a low pressure; and the electric motor and the electric control circuitry; and a coolant flow passage that is formed at the inside of the housing, wherein the coolant flow passage is configured to enable exchange of heat between:

the coolant, which flows in the coolant flow passage; and the electric motor and the electric control circuitry;

the coolant flow passage of the electric compressor is a flow passage that is configured to conduct the coolant from the high-temperature side coolant-air heat exchanger to the high-temperature side refrigerant-coolant heat exchanger;

the controller includes a processor and a memory that stores instructions configured to, when executed by the processor, cause the processor to:

activate the coolant pump at a time that is in advance of activation of the electric compressor by a predetermined time period; and deactivate the coolant pump at a time that is after elapse of a predetermined time period from a time of deactivation of the electric compressor.

* * * * *